United States Patent [19]

Huang et al.

[11] Patent Number: 4,645,003

[45] Date of Patent: Feb. 24, 1987

[54] PATTERNS OF HORIZONTAL AND VERTICAL WELLS FOR IMPROVING OIL RECOVERY EFFICIENCY

[75] Inventors: Wann-Sheng Huang; Margaret A. Hight, both of Houston, Tex.

[73] Assignee: Texaco Inc., White Plains, N.Y.

[21] Appl. No.: 812,693

[22] Filed: Dec. 23, 1985

[51] Int. Cl.[4] ..... E21B 43/24; E21B 43/30

[52] U.S. Cl. ..... 166/245; 166/50; 166/263; 166/272

[58] Field of Search ..... 166/50, 245, 263, 272

[56] References Cited

U.S. PATENT DOCUMENTS

| | | | |
|---|---|---|---|
| 4,020,901 | 5/1977 | Pisio et al. | 166/50 |
| 4,166,501 | 9/1979 | Korstad et al. | 166/245 X |
| 4,166,503 | 9/1979 | Hall et al. | 166/245 X |
| 4,177,752 | 12/1979 | Brown et al. | 166/263 |
| 4,249,604 | 2/1981 | Frazier | 166/263 |
| 4,283,088 | 8/1981 | Tabakov et al. | 166/50 X |
| 4,303,126 | 12/1981 | Blevins | 166/50 X |
| 4,384,613 | 5/1983 | Owen et al. | 166/245 X |
| 4,390,067 | 6/1983 | Willman | 166/50 X |
| 4,456,065 | 6/1984 | Heim et al. | 166/272 X |

*Primary Examiner*—George A. Suchfield

*Attorney, Agent, or Firm*—Jack H. Park; Kenneth R. Priem; Harold J. Delhommer

[57] ABSTRACT

The disclosed invention is a method of recovering hydrocarbons by employing a seven well pattern comprising five horizontal production wells and two vertical injection wells. Four of the horizontal wells form the four sides of a substantially rectangular pattern with the fifth horizontal well aligned on a diagonal running between two opposite corners of the substantially rectangular pattern formed by the first four horizontal wells. Two vertical injection wells are approximately located near the center of the two substantially triangular patterns formed by the five horizontal wells.

5 Claims, 1 Drawing Figure

PATTERNS OF HORIZONTAL AND VERTICAL WELLS FOR IMPROVING OIL RECOVERY EFFICIENCY

BACKGROUND OF THE INVENTION

The invention process is concerned with the enhanced recovery of oil from underground formations. More particularly, the invention relates to a method for recovering hydrocarbons with a seven well pattern containing five horizontal production wells and two vertical injection wells.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unsually large number of injection wells. U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot.

SUMMARY OF THE INVENTION

The invention is a method of recovering hydrocarbons from an underground formation by employing a seven well pattern comprising five substantially horizontal production wells and two substantially vertical injection wells. The pattern is formed by four of the horizontal wells forming the four sides of a substantially rectangular pattern with the fifth horizontal well aligned on a diagonal running between two opposite corners of the substantially rectangular pattern formed by the first four horizontal wells. Two vertical injection wells are approximately located near the center of the two substantially triangular patterns formed by the five horizontal wells.

DETAILED DESCRIPTION

Figure 1:
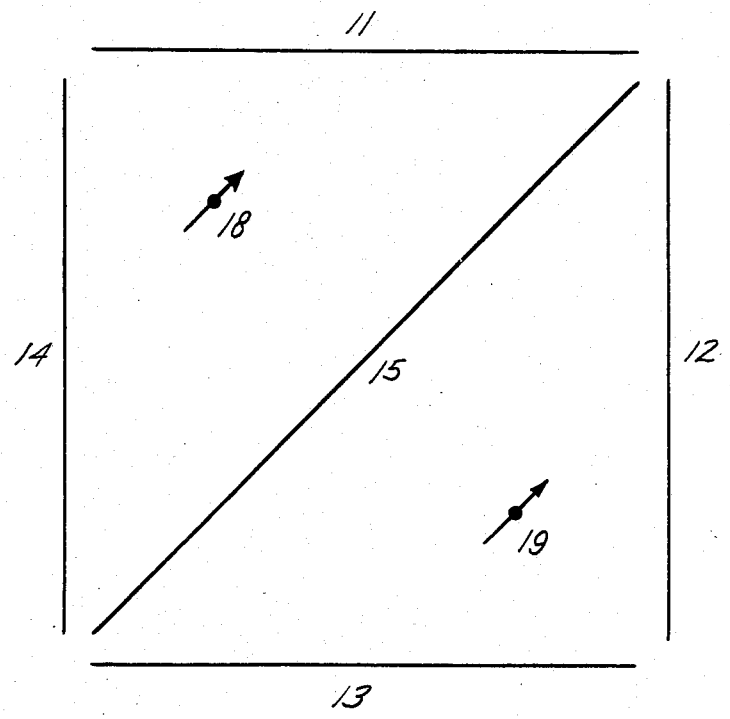
FIG. 1 illustrates the seven well pattern of the invention.

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, Arctic or environmentally sensitive areas where drill site preparation is a major expense. Thirdly, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides potential of improving sweep efficiency of a flood and therefore increasing recovery efficiency.

However, horizontal wells are significantly more expensive to drill than vertical wells. In addition, all existing hydrocarbon reservoirs have vertical wells which have already been drilled in the reservoirs. Thus, ways must be found to coordinate the use of horizontal wells with existing vertical well patterns.

The invention method provides a way of achieving horizontal well advantages by using horizontal wells in conjunction with vertical wells for improving oil recovery efficiency. The invention requires that four substantially horizontal production wells be drilled and completed such that the four horizontal wells form the four sides of a substantially rectangular pattern. It is preferred that the four horizontal production wells have approximately the same length. A fifth substantially horizontal production well is drilled and completed so that its length is aligned on a diagonal running between two opposite corners of the substantially rectangular pattern formed by the four horizontal wells.

Formation characteristics and existing vertical wells may require that the pattern be shaped roughly like a quadrilateral without ninety degree angles. Such patterns are intended to be encompassed within the phrase "substantially rectangular pattern".

The five horizontal wells are all located so that a sufficient distance exists between the ends of each of the five horizontal wells to the ends of the other horizontal wells to prevent direct communication between the different horizontal wells. Preferably, this sufficient distance is at least 30 feet of undrilled formation. Large thief zones or fractures will preferably not run between the ends of the horizontal wells.

First and second substantially vertical injection wells are located approximately near the center of the two substantially triangular patterns formed by the five horizontal wells. It is preferred, but not essential that the vertical injection wells and the horizontal production wells are completed in the bottom third of the hydrocarbon formation. Most preferably, the wells are completed in the bottom fifth of the formation.

FIG. 1 diagrams the seven well pattern of the invention. Wells 11, 12, 13 and 14 are the horizontal wells forming the four sides of the substantially rectangular pattern. Well 15 is the well aligned on the diagonal of the rectangular pattern with wells 18 and 19 being the vertical injection wells.

Simulation results indicate that the use of horizontal wells in conjunction with vertical wells according to the invention are highly effective in recovering oil, particularly oil from blind spot areas in mature steam floods. The horizontal wells speed oil recovery and thus, shorten project lives. Although the invention method may be practiced in most hydrocarbon reservoirs, production economics will probably limit its use to thermal recovery in heavy oil reservoirs for the next few years.

Horizontal wells must extend from the surface and run a substantially horizontal distance within the hydrocarbon formation. The diameter and length of the horizontal wells in their perforation intervals are not critical, except that such factors will affect the well spacing and the economics of the process. Perforation size will be a function of factors such as flow rate, temperatures and pressures employed in a given operation. Such decisions should be determined by conventional drilling criteria, the characteristics of the specific formation, the economics of a given situation, and the well known art of drilling horizontal wells.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for thermal recovery operations was employed for the examples. The model used was "Combustion and Steamflood Model-THERM" by Scientific-Software Intercomp. The model accounts for three phase flow described by Darcy's flow equation and includes gravity, viscous and capillary forces. Heat transfer is modeled by conduction and convection. Relative permeability curves are temperature dependent. The model is capable of simulating well completions in any direction (vertical, horizontal, inclined or branched).

Reservoir properties used in the study are typical of a California heavy oil reservoir with unconsolidated sand. A dead oil with an API gravity of 13 degrees was used in the simulation. The assumed reservoir properties are listed in Table 1.

EXAMPLE 1

An 18.5 acre (7.5 ha) inverted 9 spot pattern was used as a basis for this simulation study. The 125-foot (38-m) thick formation is divided into five equal layers. All wells were completed in the lower 60% of the oil sand. Steam at 65% quality was injected into the central well at a constant rate of 2400 BPD (381 $m^3/d$) cold water equivalent. The project was terminated when the fuel required to generate steam was equivalent to the oil produced from the pattern or instantaneous steam-oil ratio (SOR) of 15. A maximum lifting capacity of 1000 BPD (159 $m^3/d$) was assumed for each producing well.

The resulting oil recovery at the end of the project life (15 years) was 64.7% of the original oil in place. The predicted oil saturation profile indicates a good steam sweep throughout the upper three layers to an oil saturation less than 0.2 (the upper 60% of the oil zone), but steam bypassed most of the lower two layers except near the injection well.

EXAMPLE 2

Infill wells were added to the simulation grid midway between center and corner wells to form an inverted 13 spot pattern. The wells were completed in the lower one-third of the zone only and infill production began after three years of steam injection and continued to the end of the project.

Ultimate recovery was 63.2% of the original oil in place after 11 years. Note that the advantage of infill wells is to recover oil sooner. For the inverted 9 spot pattern of Ex. 1, the oil recovery at 11 years would have been only 57% at this time. Because of the presence of infill wells, oil production which would otherwise arrive at corner and side wells will be reduced. As a result, the inverted 13 spot pattern would reach economic limit much sooner than an inverted 9 spot pattern unless other operational changes are made.

The oil saturation profile for Example 2 is about the same as for Ex. 1, but is reached four years sooner than in Ex. 1. There is still a high oil saturation region in the area between the corner and side wells.

EXAMPLE 3

The configuration of FIG. 1 was simulated and compared with the base cases of Examples 1 and 2. There are two vertical injectors and three horizontal producers per pattern in this configuration. Peripheral horizontal wells are shared by adjacent patterns. One-fourth of the pattern was simulated.

To keep the drilling cost per acre similar to that of Examples 1 and 2, the pattern size was increased to 26 acres (10.5 ha) for Example 3. Injection rate was 2800 BPD (445 $m^3/d$) or 0.9 BPD per acre foot. Vertical wells were completed in the lower three layers of the simulation grid only and all horizontal wells were completed in the bottom (5th layer) of the simulation grid. The central horizontal well had a length of 752 feet and the peripheral horizontal wells had a length of 532 feet. All wells had a diameter of six inches.

The resulting recovery after 14 years and 1.4 pore volumes of steam injection was 72.9% of the original oil in place. It is also possible to lower the project's overall steam requirements by converting to water injection from steam injection during the later years of the project.

Some steam override occurred in this pattern, leaving a small blind spot area at the ends of the central horizontal well where the distance to the injection wells is greater. Oil saturations in the blind spots were 50% in the bottom layer 5, but this area only represented 8% of the total pattern area and less than 2% of the pattern volume.

Many variations of the method of this invention will be apparent to those skilled in the art from the foregoing discussion and examples. Variations can be made without departing from the scope and spirit of the following claims.

TABLE 1

RESERVOIR AND FLUID PROPERTIES - SIMULATION OF EXAMPLES 1–4

| | |
|---|---|
| Porosity, fraction | 0.39 |
| Initial Fluid Saturations, Fraction: | |
| Oil | 0.589 |
| Water | 0.411 |
| Gas | 0 |
| Initial Reservoir Temperature, °F. (°C.) | 100 (37.7) |
| Initial Reservoir Pressure, psi (kPa) | 50 (345) |
| Permeability, md: | |
| Horizontal ($\mu m^2$) | 3000 (3) |
| Vertical ($\mu m^2$) | 900 (0.9) |
| Reservoir Thermal Conductivity, Btu/day-ft-°F. (W/m-°C.) | 31.2 (2.25) |

TABLE 1-continued

| RESERVOIR AND FLUID PROPERTIES - SIMULATION OF EXAMPLES 1-4 | | |
|---|---|---|
| Reservoir Heat Capacity, Btu/ft$^3$-°F. (kJ/m$^3$-°C.) | | 37.0 (2481) |
| Cap and Base Rock Thermal Conductivity, Btu/day-ft-°F. (W/m-°C.) | | 24.0 (1.73) |
| Cap and Base Rock Heat Capacity, Btu/ft$^3$-°F. (kJ/m$^3$-°C.) | | 46.0 (3085) |
| Oil Viscosity, | cp @ °F. | Pa.s @ °C. |
| | 1230 @ 100 | 1.23 @ 37.7 |
| | 10 @ 300 | 0.01 @ 148.9 |
| | 3.99 @ 400 | 0.00399 @ 204.4 |
| Quality of Injected Steam, fraction (at sand face) | | 0.65 |
| Residual Oil Saturation, Fraction | | |
| to water: | | 0.25 |
| to steam: | | 0.15 |

What is claimed is:

1. A method of recovering hydrocarbons from an underground formation by employing a seven well pattern, which comprises:

four substantially horizontal production wells, each horizontal well forming a side of a substantially rectangular pattern;

a fifth substantially horizontal production well aligned on a diagonal running between two opposite corners of the substantially rectangular pattern formed by the four horizontal wells, said five horizontal production wells extending from the ground surface and running a substantially horizontal distance within the hydrocarbon formation, said five horizontal wells located so that a sufficient distance exists between the ends of the five horizontal wells to prevent direct communication between the different horizontal production wells;

first and second substantially vertical injection wells, said first injection well approximately located near the center of one of the two substantially triangular patterns formed by the five horizontal wells, and said second injection well approximately located near the center of the other substantially triangular pattern formed by the five horizontal wells.

2. The hydrocarbon recovery method of claim 1, wherein the horizontal wells are completed in the bottom third of the hydrocarbon formation.

3. The hydrocarbon recovery method of claim 1, wherein the vertical injection wells are completed in the bottom third of the hydrocarbon formation.

4. The hydrocarbon recovery method of claim 1, wherein the distance between the ends of the horizontal wells is at least 30 feet.

5. A method of recovering hydrocarbons from an underground formation by employing a seven well pattern, which comprises:

four substantially horizontal production wells completed in the bottom third of the formation, each horizontal well forming a side of a substantially rectangular pattern;

a fifth substantially horizontal production well completed in the bottom third of the formation and aligned on a diagonal running between two opposite corners of the substantially rectangular pattern formed by the four horizontal wells, said five horizontal production wells extending from the ground surface and running a substantially horizontal distance within the hydrocarbon formation, said five horizontal wells located so that at least 30 feet of formation exists between the ends of the five horizontal wells;

first and second substantially vertical injection wells completed in the bottom third of the formation, said first injection well approximately located near the center of one of the two substantially triangular patterns formed by the five horizontal wells, and said second injection well approximately located near the center of the other substantially triangular pattern formed by the five horizontal wells.

* * * * *